US011566753B2

(12) United States Patent
Patelczyk et al.

(10) Patent No.: US 11,566,753 B2
(45) Date of Patent: Jan. 31, 2023

(54) VAPOR PRESSURE REGULATOR FOR CRYOGENIC LIQUID STORAGE TANKS AND TANKS INCLUDING THE SAME

(71) Applicant: Chart Inc., Ball Ground, GA (US)

(72) Inventors: Jeff Patelczyk, Cumming, GA (US); Ian Neeser, Bloomington, MN (US); Paul Drube, Lakeville, MN (US)

(73) Assignee: Chart Inc., Ball Ground, GA (US)

( * ) Notice: Subject to any disclaimer, the term of this patent is extended or adjusted under 35 U.S.C. 154(b) by 353 days.

(21) Appl. No.: 16/725,590

(22) Filed: Dec. 23, 2019

(65) Prior Publication Data

US 2020/0208779 A1 Jul. 2, 2020

Related U.S. Application Data

(60) Provisional application No. 62/785,508, filed on Dec. 27, 2018.

(51) Int. Cl.
*F17C 7/04* (2006.01)

(52) U.S. Cl.
CPC ..... *F17C 7/04* (2013.01); *F17C 2223/0161* (2013.01); *F17C 2227/0107* (2013.01); *F17C 2227/03* (2013.01); *F17C 2250/0439* (2013.01); *F17C 2250/0626* (2013.01)

(58) Field of Classification Search
CPC ..... F17C 7/04; F17C 2223/0161; F17C 2227/03; F17C 2227/0107; F17C 2250/0439; F17C 2250/0626; F17C 2227/0372; F17C 5/02
See application file for complete search history.

(56) References Cited

U.S. PATENT DOCUMENTS

| | | | | |
|---|---|---|---|---|
| 3,260,060 | A | 7/1966 | Paulinkonis et al. | |
| 4,783,969 | A * | 11/1988 | Hohol | F17C 9/00 62/51.1 |
| 5,579,646 | A * | 12/1996 | Lee | F17C 9/00 62/48.1 |
| 7,481,074 | B2 * | 1/2009 | Cirucci | F25J 3/028 62/48.1 |
| 2007/0068177 | A1 * | 3/2007 | Higginbotham | F17C 13/12 62/47.1 |

FOREIGN PATENT DOCUMENTS

| | | |
|---|---|---|
| JP | S5210611 U | 1/1977 |
| WO | 2017017364 A2 | 2/2017 |

OTHER PUBLICATIONS

Extended European Search Report from the European Patent Office for EPO Application No. EP19219863.8, dated May 12, 2020 (7 pages total).

* cited by examiner

*Primary Examiner* — Devon Russell
(74) *Attorney, Agent, or Firm* — Cook Alex Ltd.

(57) ABSTRACT

Gas pressure actuated fill termination valves for cryogenic liquid storage tanks and storage tanks containing the same.

7 Claims, 1 Drawing Sheet

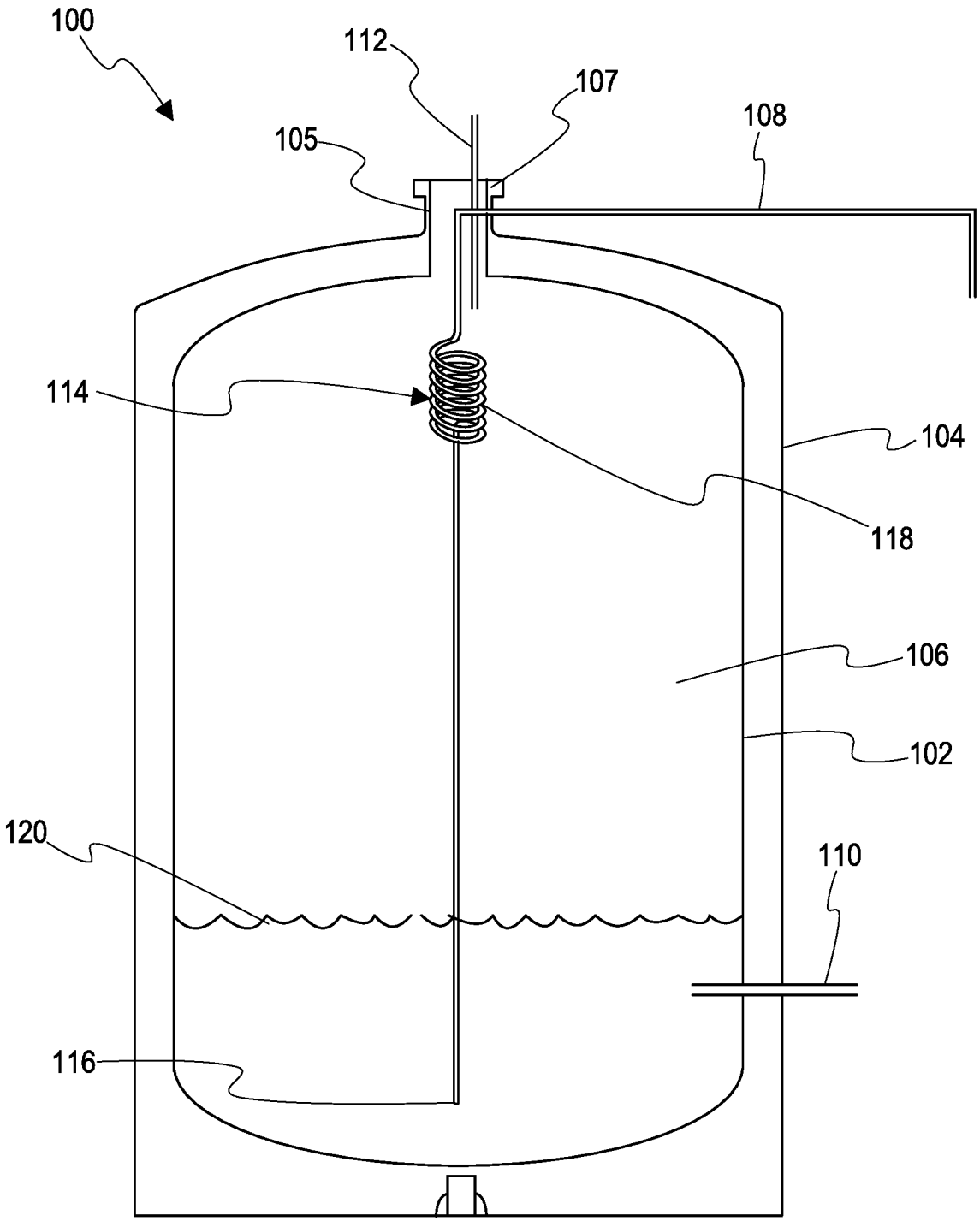
100
112
107
108
105
114
104
118
106
102
120
110
116

VAPOR PRESSURE REGULATOR FOR CRYOGENIC LIQUID STORAGE TANKS AND TANKS INCLUDING THE SAME

CLAIM OF PRIORITY

This application claims the benefit of U.S. Provisional Application No. 62/785,508, filed Dec. 27, 2018, the contents of which are hereby incorporated by reference.

FIELD OF THE DISCLOSURE

The present disclosure relates generally to systems and methods for regulating vapor pressure in a cryogenic liquid storage tank during the fill process. More particularly, the present disclosure relates to heat exchangers for cryogenic liquid storage tanks that assist in regulating vapor pressure during the fill process.

A cryogenic liquid storage tank may include a top fill circuit or a bottom fill circuit. Both of these circuits drastically change the vapor pressure within the tank during the fill process. Thus, tanks utilizing these circuits require multiple valves, along with manual operation of these valves, in order to find a balance in vapor pressure during filling of the tank. That is, the person filling the tank must monitor the pressure within the tank and adjust the throttling of the fill pipe valves accordingly.

There remains a need for fill systems and tanks with vapor pressure regulation.

SUMMARY OF THE DISCLOSURE

There are several aspects of the present subject matter which may be embodied separately or together in the methods, devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a cryogenic liquid storage tank includes a vessel for containing a cryogenic liquid and a fill pipe in communication with the vessel wherein the vessel is filled with the cryogenic liquid via the fill pipe. The storage tank also includes a heat exchanger located within the vessel. The heat exchanger has a heat exchanger passageway in fluid communication with the fill pipe, wherein the cryogenic liquid flows through the heat exchanger passageway during filling of the vessel.

In another aspect, a method of filling a cryogenic liquid storage tank with a cryogenic liquid. The method includes flowing cryogenic liquid into a vessel of the tank. The liquid then flows through a heat exchanger, wherein the heat exchanger is located within the tank. The liquid then flows out of the heat exchanger and into the tank.

BRIEF DESCRIPTION OF THE DRAWINGS

FIG. 1 illustrates one embodiment of a storage tank having a vapor pressure regulator in accordance with the present disclosure.

DETAILED DESCRIPTION OF EMBODIMENTS

FIG. 1 illustrates an implementation of a storage tank 100. In the illustrate embodiment, the storage tank 100 is a vertical storage tank. In other embodiments, the storage tank 100 may be a horizontal storage tank. The storage tank 100 may be a cryogenic liquid storage tank. The storage tank 100 includes an inner vessel 102. The inner vessel 102 is enclosed by an outer vessel 104. The inner vessel 102 can enclose an interior chamber 106. The inner vessel 102 is joined to the outer vessel 104 by an inner vessel support member 105. The inner vessel support member 105 may be connected, at its top end, to an outer component (for example, outer knuckle or outer joint) 107 or to an outer vessel. The inner chamber 106 receives the liquefied gas through a fill pipe 108, stores the liquefied gas, and provides fluid to a use device (for example, a laser cutter, a welder, a food refrigeration device, or any other suitable device) through a withdrawal pipe 110. The fill and withdrawal pipes may be any suitable conduit for conveying or allowing the flow of fluid therethrough. Excess vapor can be exhausted through a vent line 112. The fill pipe 108, the withdrawal pipe 110, and the vent line 112 pass through the inner vessel support member 105, which is open from both top and bottom. In one implementation, the stay and support members can be tubes. In some other implementations, the members can be other types of similar structures, such as passages, pipes, or the like. The cross-sections of these tubes and other structures can have various shapes, such as a circle, ellipsis, square, triangle, pentagon, hexagon, polygon, and other shapes.

When the tank 100 is employed to store cryogenic liquids, the liquids may be liquefied gases. For example, the cryogenic liquids can be at least one of nitrogen, helium, neon, argon, krypton, hydrogen, methane, liquefied natural gas, and oxygen, although other types of gases are within the scope of this disclosure.

The tank 100 may include a heat exchanger 114 that has a heat exchanger passageway therethrough. The heat exchange passageway is in fluid communication with the fill pipe 108 so that cold liquid coming in through fill pipe 108 flows through the heat exchanger 114. The heat exchanger 114 includes an outlet end 116 in fluid communication with the heat exchanger passageway, wherein the liquid 120 is dispensed from the outlet end and into the vessel 102 to fill the tank 100. In one embodiment the outlet end 116 is positioned or located so as to dispense the incoming liquid into an existing liquid volume of the tank, which is similar to a traditional bottom fill system.

The heat exchanger 114 may be the illustrated coiled heat exchanger 118. In other embodiments, the heat changer may be a serpentine heat exchanger or tube heat exchanger. The heat exchanger 114 is located in the vessel 102, and is preferably located in the ullage or headspace of the tank. As the cold incoming liquid flows through the heat exchanger 114, the heat exchanger condenses the hotter gas around, thus reducing the vapor pressure within the tank 100. Additionally, as liquid 120 is dispensed out of the outlet end 116 of the heat exchanger near the bottom of the vessel 102, vapor pressure builds within the tank 100, similar to that of a traditional bottom fill. As the level of liquid 120 increases, the gas space compresses, and the pressure in the tank rises as a result. The heat exchanger, e.g. coil, serpentine or tube, can be differently sized and shaped depending on the tank and the type of liquid the tank is designed to store. The heat exchanger may be designed so that the pressure reducing effect from the heat exchanger and the pressure increasing effect from the liquid level increase cancel each other out. This may result in the tank maintaining its pre-fill vapor pressure consistently throughout the filling process.

The heat exchanger may eliminate the need to monitor the pressure and the need to adjust the throttling of the fill line valves. Because the valves do not need to be throttled, they can be removed, saving cost and reducing potential leak points on the tank. Also, since the operator filling the tank will not need to closely monitor the pressure, he/she can allocate more time to other aspects of the filling process, such as safety.

While the preferred embodiments of the disclosure have been shown and described, it will be apparent to those skilled in the art that changes and modifications may be made therein without departing from the spirit of the disclosure, the scope of which is defined by the following claims.

What is claimed is:

1. A cryogenic liquid storage tank, comprising:

an inner vessel for containing a cryogenic liquid, the vessel having a top end portion, a bottom end portion, and a headspace at the top end portion;

a fill pipe located at the top end portion of the vessel and in communication with the vessel, wherein the vessel is filled with incoming cryogenic liquid via the fill pipe;

a withdrawal pipe located at the bottom end portion of the vessel; and a heat exchanger located within the vessel, the heat exchanger having a coiled or serpentine heat exchanger passageway in fluid communication with the fill pipe so that incoming cryogenic liquid coming in through the fill pipe flows through the coiled or serpentine heat exchanger passageway, the coiled or serpentine heat exchanger passageway located in only the headspace of the vessel, wherein the incoming cryogenic liquid flows through the coiled or serpentine heat exchanger passageway during filling of the vessel and the heat exchanger condenses gas within the headspace; and the heat exchanger includes an outlet end having a passageway that extends downward from the coiled or serpentine heat exchanger passageway, the outlet end's passageway being in fluid communication with the coiled or serpentine heat exchanger passageway so that incoming cryogenic liquid flows from the coiled or serpentine heat exchanger passageway, though the outlet end's passageway and dispensed into the bottom end portion of the vessel.

2. The cryogenic liquid storage tank of claim 1 wherein the outlet end's passageway is positioned to dispense the incoming cryogenic liquid into an existing volume of liquid in the inner vessel.

3. The cryogenic liquid storage tank of claim 1 wherein the outlet end is located below the headspace.

4. The cryogenic liquid storage tank of claim 1 wherein the outlet end is configured to dispense cryogenic liquid into an existing volume of the liquid in the vessel.

5. The cryogenic liquid storage tank of claim 1 wherein the heat exchanger assists in maintaining a selected vapor pressure within the inner vessel of the tank.

6. A method of filling a cryogenic liquid storage tank with a cryogenic liquid, the method comprising:

flowing cryogenic liquid into a fill pipe of the tank;

flowing the cryogenic liquid through a coiled or serpentine passageway of a heat exchanger within the tank, wherein the coiled or serpentine passageway is located only within a headspace of the tank;

condensing gas with the headspace with the heat exchanger as cryogenic liquid flows through the heat exchanger;

flowing the cryogenic liquid out of the coiled or serpentine passageway of the heat exchanger and through an outlet passageway of the heat exchanger; and flowing the cryogenic liquid out of the outlet passageway of the heat exchanger and into the tank.

7. The method of claim 6, further comprising withdrawing cryogenic liquid from the tank through a withdrawal pipe located at a bottom portion of the tank.

* * * * *